US005088121A

United States Patent [19]

Wallace

[11] Patent Number: 5,088,121

[45] Date of Patent: Feb. 18, 1992

[54] GLOVE WITH A POCKET FOR HOLDING MACE AND A METHOD OF MAKING SAME

[76] Inventor: Jacqueline E. Wallace, 2383 23rd St., 2nd Flr., Astoria, N.Y. 11105

[21] Appl. No.: 647,542

[22] Filed: Jan. 29, 1991

[51] Int. Cl.[5] ..... A41D 19/00

[52] U.S. Cl. ..... 2/160; 2/158; 2/159; 2/163; 224/218

[58] Field of Search ..... 2/158, 159, 160, 161, 2/161 A, 163; 224/218

[56] References Cited

U.S. PATENT DOCUMENTS

| | | | |
|---|---|---|---|
| D. 256,266 | 8/1980 | Sorgnard | D22/14 |
| D. 274,287 | 6/1984 | Brookshire | D22/1 |
| D. 275,696 | 9/1984 | Mader | D22/1 |
| D. 306,366 | 2/1990 | Turpie | D32/42 |
| 1,479,771 | 1/1924 | Campbell | 2/159 |
| 2,294,997 | 9/1942 | Merrion | 2/160 |
| 2,522,344 | 9/1950 | Carmin | 2/160 |
| 3,443,333 | 5/1969 | Manatos | 42/1 |
| 3,629,867 | 12/1971 | Taylor | 2/160 |
| 4,149,296 | 4/1979 | Stanford | 17/66 |
| 4,316,338 | 2/1982 | Mason | 42/1 |
| 4,326,706 | 4/1982 | Guthrie et al. | 2/160 |
| 4,402,430 | 9/1983 | Fox | 222/183 |
| 4,433,500 | 2/1984 | Kunevicius | 42/1 |
| 4,447,912 | 5/1984 | Morrow | 2/160 |
| 4,477,005 | 10/1984 | Martinez | 224/218 |
| 4,504,980 | 3/1985 | Butcher | 2/160 |
| 4,625,339 | 12/1986 | Peters | 2/160 |
| 4,691,387 | 9/1987 | Lopez | 2/161 |
| 4,712,253 | 12/1987 | Chen | 2/159 |
| 4,754,498 | 7/1988 | Stinemates | 2/17 |
| 4,778,181 | 10/1988 | Arney | 273/84 |
| 4,805,242 | 2/1989 | Bolton | 2/160 |
| 4,813,082 | 3/1989 | Kallman | 2/158 |
| 4,938,487 | 7/1990 | Ponsart | 2/160 |
| 5,003,637 | 4/1991 | Lonon | 2/160 |

*Primary Examiner*—Werner H. Schroeder
*Assistant Examiner*—Gloria Hale
*Attorney, Agent, or Firm*—Head & Johnson

[57] ABSTRACT

A glove or mitten with a pocket in the palm thereof to hold a container of chemical repellant, such as Mace.

5 Claims, 2 Drawing Sheets

GLOVE WITH A POCKET FOR HOLDING MACE AND A METHOD OF MAKING SAME

BACKGROUND OF THE INVENTION

1. Field of the Invention

This invention relates to the field of handheld repellant devices that are attached, or otherwise secured to the hand.

2. Description of the Related Art

Various types of repellant materials are available; MACE is probably the most common, although tear-gas, and other forms of chemical repellants are known and available. Mace and tear gas are readily commercially available in small pressurized aerosol containers or canisters.

The currently available forms of repellants, and their holders, are designed to be carried in a purse, pocket, or held in the hand. If they are carried in a purse or pocket, it can take considerable time to retrieve the repellant, and in that time the attacker or assailant may overcome the person carrying the repellant. Further, the act of reaching for the repellant in a purse or pockets may warn the assailant and accelerate or intensify the attack. During cold weather, the victim may be wearing gloves which further encumbers his or her attempts to retrieve the repellant. On the other hand, the repellant can be carried in the hand at all times, but this becomes very tiresome if long periods of time are involved and it precludes using that hand for other functions. Joggers and walkers often carry repellant, especially if alone or in a lonely area. Further, once the repellant is in the hand, it may be dropped or lost during an attack.

To be most effective, repellant should be instantly available; the attacker should not be aware, or forewarned, of the presence of the repellant; and, the method of holding/storing the repellant should leave the hands of the owner free for other tasks yet it should secure the repellant to the hand so that it cannot be dropped or lost.

SUMMARY OF THE INVENTION

It is an object of this invention to provide a holder for a repellant canister that is instantly available for use by the owner.

It is a further object of this invention to provide a holder for a repellant canister that leaves the hands of the owner free to perform other tasks while holding the repellant, and that is comfortable for the owner to use for long periods of time.

It is a further object of this invention to provide a holder for repellant that is not obvious to an assailant.

It is a further object of this invention to provide a holder for repellant that will prevent the owner from dropping or losing the repellant during an assault.

It is a still further object of this invention to provide a method for making such a holder.

In the preferred embodiment, a glove or mitten has a pocket attached to the palm area of the glove or mitten. This pocket is sized to hold a canister of MACE, tear gas or other repellant. The pocket is placed transversely across the palm, near the base of the fingers in the area of the metacarpal heads, with the opening of the pocket facing the space between the thumb and index finger.

When the MACE or repellant canister is fitted into the pocket, the spray end and control is between the thumb and index finger, ready for immediate use. The pocket may have a rubber band, a nonslip inner coating or other frictionally engaging means to hold the repellant canister in the pocket.

Thus, in this embodiment, the repellant canister is held securely in the palm of the hand, always ready for use, yet leaving the hand free for other uses as well. Further, the canister is concealed, and cannot be dropped or lost.

Other features and advantages of this invention will be disclosed below and will in part become apparent from the description or use of the invention.

DESCRIPTION OF THE PREFERRED EMBODIMENT

Figure 1:
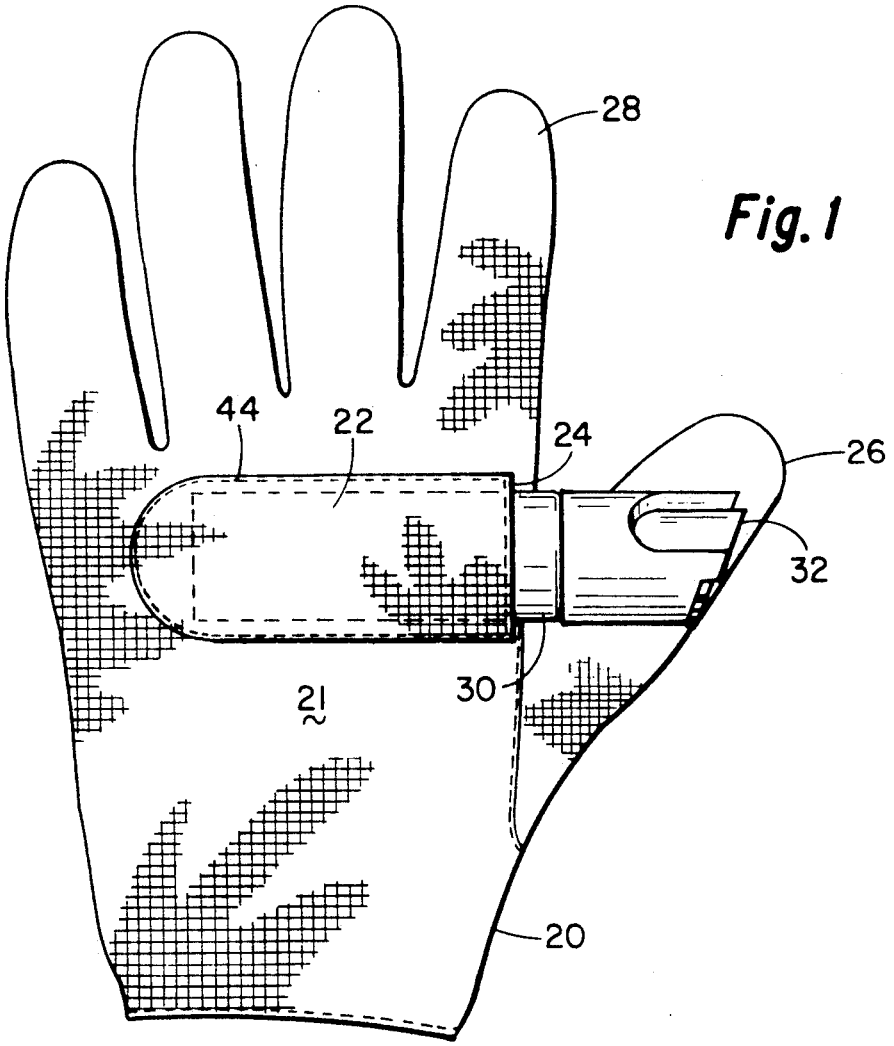
FIG. 1 is a palmar view of a glove with attached repellant containing pocket.

Referring to FIG. 1, a glove 20 has a pocket 22 placed transversely across the palm 21 of the glove 20, with the pocket opening 24 facing the space between the thumb 26 and the index finger 28. The transverse placement of the pocket 22 is optimally just proximal to the phalange-metacarpal joint, i.e. over the metacarpal head area. A canister of repellant, comprising a body 30 and a spray control mechanism 32, is placed in the pocket 22 of the glove 20 so that the spray control mechanism 32 exits the pocket opening 24, thus placing the spray control mechanism 32 between the thumb 26 and the index finger 28.

Figure 2:
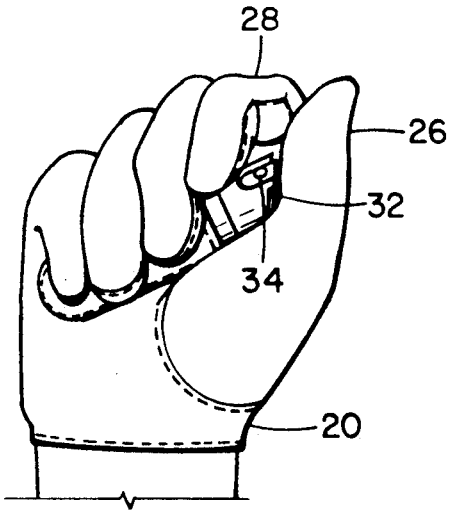
FIG. 2 is the device of FIG. 1 in use with a clenched hand.

Referring now to FIG. 2, I show the above described device in use with the glove 20 on a clenched hand. The thumb 26 is positioned to press and control the spray control mechanism 32. The spray orifice 34 faces outwardly over the flexed index finger 28.

Figure 3:
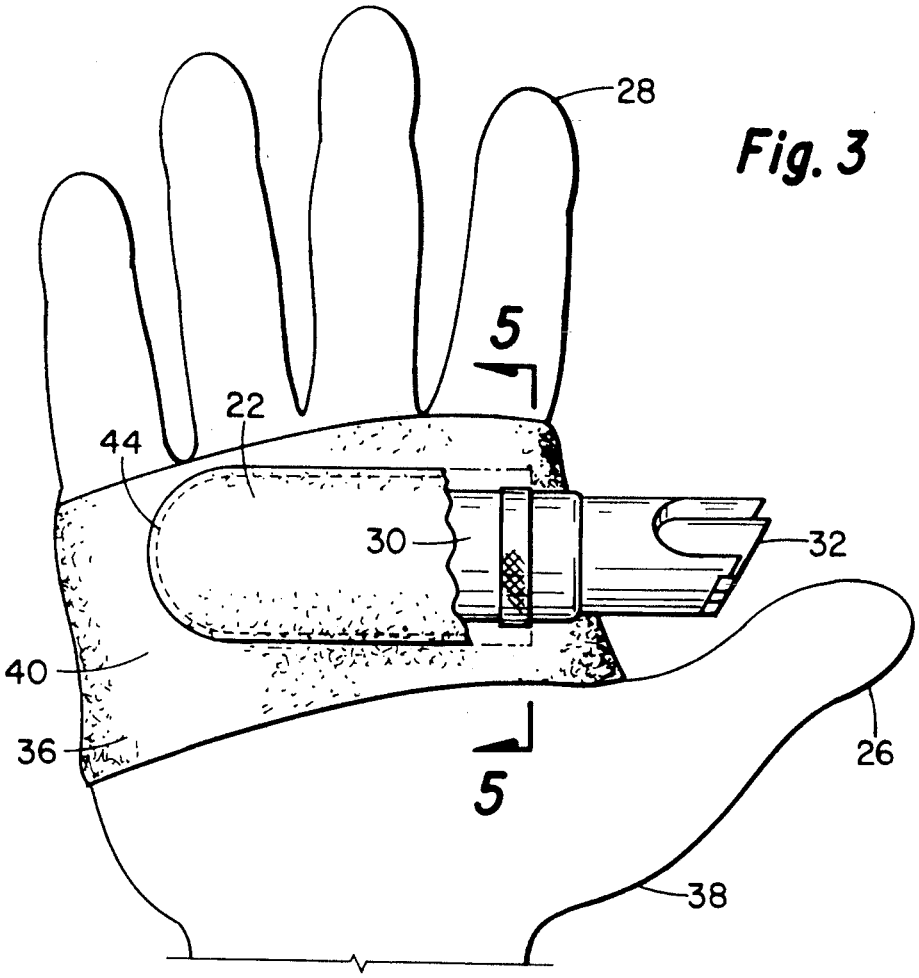
FIG. 3 is a palmar view of a band of material encircling the hand with attached repellant containing pocket.
Figure 4:
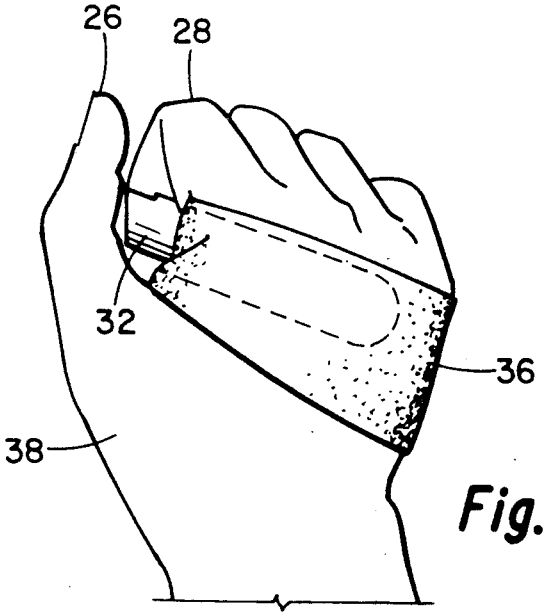
FIG. 4 is the device of FIG. 3 as seen in a clenched hand from the back of the hand.

While the preferred embodiment shows a conventional glove, other hand covering means may also be used. In FIG. 3, for example, a simple band 36 encircles the hand 38 in the area of the palm 40. A pocket 22, similar to that described in FIG. 1, is placed on the band 36 in the palm area 40 so as to hold a canister of repellant 30 with the spray control mechanism 32 between the thumb 26 and the index finger 28. FIG. 4 illustrates this configuration in a clenched hand 38 as viewed from the back of the hand. The thumb 26 is poised over the spray control mechanism 32 ready for use.

In the preferred embodiment, the pocket 22 is sewn to the palm of the glove 21 as shown in FIGS. 1 and 2. A line of stitching 44 is shown in the drawings attaching the pocket 22 to the palm and leaving an opening 24 in which to insert the canister of repellant 30. Other methods of fastening may be used such as snaps, zippers, clips, VELCRO, adhesives and the like. Alternatively, the pocket may be formed as an integral part of the glove, mitten or band during the knitting or weaving thereof, and the word "attached" in this application is to be construed as including such integral formation. The glove 21 and pocket 22 may be formed of fabric, leather, or other suitable materials. It may have fingers, partial fingers, be fingerless or be like a mitten, and it may be either right or left handed, or both.

Figure 5:
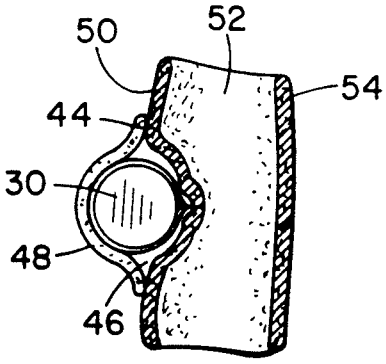
FIG. 5 is a cross-section of the pocket and glove.

FIG. 5 is a cross-section of the pocket illustrating the pocket space 46 with enclosed canister 30, the seam stitching 44 around the pocket, and the pocket material 48. In this embodiment, the glove is padded with an outer surface 50, padding 52 and inner surface 54 of the glove.

The pocket 22 may have an inner surface or band that is "non-skid," such as elastic or rubber (not illustrated) to prevent the canister 30 from sliding out of the pocket 22. The pocket 22 may be open at both ends (not shown) and it may have a flap (not shown) or other means to cover the opening. It is preferred that the end of the pocket opposite the end near the thumb be closed. This will help retain the canister in the pocket while the wearer is active.

Figure 6:
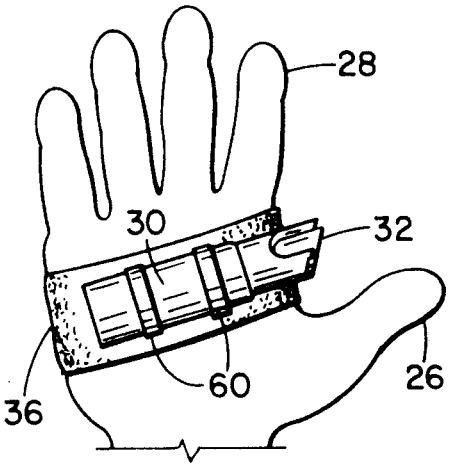
FIG. 6 is a device similar to FIG. 3 in which the pocket has been replaced by one or more bands.

In its elemental form, the invention may use a palmar band 36 as shown in FIG. 6 and one or more narrow retaining bands 60 to hold the canister 30 against the palmar band 36 in the palm of the hand. Such retaining bands 60 may be elastic, or other suitable non-skid and resilient material. The palmar band 36 may be of fabric, elastic, VELCRO, or other suitable material.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A holder for retaining a canister of repellant in the palm of the hand of the user, comprising:

a hand encircling member disposed at least around the palm of the hand, said encircling member comprised of a glove having a thumb and an index finger and a retaining means attached to said encircling member, which retains said canister of repellant in the palm of the user, said retaining means comprises a pocket having an inner surface of "non-skid" material and transversely attached to the palm area of the hand encircling member and configured to receive said canister of repellant and to fractionally engage such canister and further configured so that the pocket is open in the area between the thumb and index finger of the user.

2. The holder, as recited in claim 1, in which the transverse attachment of the pocket to the hand encircling member is in the area of the metacarpal heads, immediately proximal to the phalangeal-metacarpal joints of the fingers.

3. The holder, as recited in claim 1, in which said glove is at least partially fingerless.

4. The holder, as recited in claim 1, in which said hand encircling member is a mitten.

5. A holder for retaining a canister of repellant in the palm of the hand of the user, comprising:

a hand encircling member disposed at least around the palm of the hand;

as retaining means, attached to said hand encircling member, which retains said canister of repellant in the palm of the user wherein said retaining means is at least one elastic band-like member having two ends, both of which are attached to the palm area of said hand encircling member, and configured so as to frictionally engage and hold a canister of repellant in said palm of the hand.

* * * * *